United States Patent [19]

Nafti

[11] Patent Number: 4,987,624

[45] Date of Patent: Jan. 29, 1991

[54] DEVICE FOR IMPARTING MULTI-DIRECTIONAL ROCKING MOTION

[76] Inventor: David I. Nafti, c/o Schweitzer & Cornman, 230 Park Ave., New York, N.Y. 10169

[21] Appl. No.: 163,294

[22] Filed: Mar. 2, 1988

[51] Int. Cl.[5] ..... A47D 15/00; B62B 9/22

[52] U.S. Cl. ..... 5/109; 74/30

[58] Field of Search ..... 272/53.1; 74/30, 44; 5/108, 109, 104; 297/260

[56] References Cited

U.S. PATENT DOCUMENTS

| | | | |
|---|---|---|---|
| 659,866 | 10/1900 | Cytron et al. | 5/109 X |
| 669,980 | 3/1901 | Cutten | 5/109 X |
| 2,765,478 | 10/1956 | Pinto | 5/109 X |
| 2,908,917 | 10/1959 | Pinson | 5/109 |
| 3,031,686 | 5/1962 | Muzeey | 5/109 |
| 3,139,630 | 7/1964 | Hunt | 5/109 |
| 3,371,358 | 3/1968 | Shackel | 5/109 X |
| 3,628,620 | 12/1971 | Byers | 5/109 X |
| 3,851,343 | 12/1974 | Kinslow, Jr. | 5/109 X |

FOREIGN PATENT DOCUMENTS

| | | | |
|---|---|---|---|
| 1294774 | 4/1962 | France | 5/109 |
| 2317149 | 2/1977 | France | 5/109 |

*Primary Examiner*—Richard E. Chilcot, Jr.

*Attorney, Agent, or Firm*—Andrew S. Langsam; Edward Langer

[57] ABSTRACT

A device for imparting multi-directional rocking motion comprising a housing, a drive mechanism supported by the housing for providing reciprocating motion to an arm extending through a wall thereof, and an adjustable orientation attachment clamp for attaching the housing to a component arranged for rocking motion in relation to a surface, the housing being attached so as to direct the arm for contact with the surface during its reciprocating motion, the rocking motion being imparted to the component in accordance with the arm direction.

3 Claims, 5 Drawing Sheets

DEVICE FOR IMPARTING MULTI-DIRECTIONAL ROCKING MOTION

FIELD OF THE INVENTION

The present invention relates to devices for imparting rocking motion to child care accessories and the like, and more particularly, to a self-contained mechanism which is easily connectable to such accessories to impart a muti-directional rocking motion.

BACKGROUND OF THE INVENTION

It is known in the prior art to use mechanicla systems for imparting a rocking motion to cradles, cribs, and the like, for inducing sleep in infants. Examples of simple manual systems for this purpose include the early cradle design of U.S. Pat. No. 141,033 to Chichester, and the cradle holder of U.S. Pat. No. 4,081,869 to Ash.

Examples of systems for imparting mechanized rocking motion without the need for manual rocking by the parent or child care assistant were described briefly in my previously issued U.S. Pat. No. 4,752,980. There it was stated that prior art systems are generally complicated by the fact that each requires a support frame having a stationary and a movable portion. A mechanism mounted on the stationary portion imparts rocking motion to the movable portion. A list of patents which outline the prior art follows:

U.S. Pat. No. 1,420,134 to Nisle
U.S. Pat. No. 1,500,009 to Smaldone
U.S. Pat. No. 1,662,754 to Millard
U.S. Pat. No. 1,733,115 to Capito et al
U.S. Pat. No. 1,795,246 to Brown
U.S. Pat. No. 2,311,542 to Holme
U.S. Pat. No. 2,478,445 to Yurkovich
U.S. Pat. No. 2,482,318 to Carruth
U.S. Pat. No. 2,505,626 to Palmer
U.S. Pat. No. 2,841,802 to Leverett
U.S. Pat. No. 2,869,538 to Hawk
U.S. Pat. No. 3,952,343 to Wong
U.S. Pat. No. 3,992,731 to Carswell
U.S. Pat. No. 4,028,753 to Rios
U.S. Pat. No. 4,277,857 to Svehaug
U.S. Pat. No. 4,586,492 to Manahan All of the above prior art patents can be characterized by their disclosure of cumbersome mechanical arrangements requiring a base for supporting a driving mechanism achieving a predetermined directional rocking motion, e.g., a back-and-forth longitudianl motion of a bed or crib, etc. Because they are pre-designed systems, all of the mechanical linkages connecting the driving mechanism to the crib are also predetermined. This limits flexibility of usage with various child care accessories.

The child care accessories available in the market today include many variations of infant seats, carry cradles and other portable components which secure an infant for transportation purposes and placement in the home environment. When at rest, many of these accessories are capable of being manually rocked to soothe irritated infants and induce sleep, but none of the mechanical systems heretofore described are applicable to these accessories for imparting mechanized rocking motion.

Therefore, it would be desireable to provide a simple, portable, easily adjustable, safe and reliable device for imparting multi-directional rocking motion to child care accessories.

SUMMARY OF THE INVENTION

Accordingly, it is a principal object of the present invention to provide a self-contained, portable mechanism which is easily mountable directly to many child care accessories to impart a rocking motion, without requiring the use of a supporting frame.

In accordance with the present invention, there is provided a device for imparting multi-directional rocking motion comprising:

a housing;

a drive mechanism supported by said housing for providing reciprocating motion to an arm extending through a wall thereof; and means for attaching said housing to a component arranged for rocking motion in relation to a surface, said housing being attached so as to direct said arm for contact with said surface during its reciprocating motion, said rocking motion being imparted to said component in accordance with said arm direction.

In a preferred embodiment, the inventive device for imparting a multi-directional rocking motion is designed as a self-contained, portable unit enclosed by a housing having an attachment clamp, making it easily attachable to a child care accessory such as an infant seat, cradle, chair or rocking horse. A reciprocating arm extending through a housing wall is driven by a battery-powered mechanism within the housing. By attaching the housing to the accessory so tht the reciprocating arm is directed against a stationary surface, rocking motion is imparted to the accessory.

By virtue of its novel design. the inventive device imparts multi-directional rocking motion which is not limited to a predetermined direction, since many variations can be obtained in the attachment of the housing to the child care accessory. Since many of these child care accessories are shaped so as to be suited to rocking motion, the housing can be directly attached.

Effectively, the inventive device replaces the stationary support base and complex driving mechanisms of prior art systems with a simplified mechanism providing its own "base" as the direct attachment point on the accessory, so that the drive mechanism base becomes part of the accessory itself. Thus, the inventive device provides a simple solution to the existing problems in automatic systems for imparting rocking motion. A feature of the inventive device is the provision of the attachment clamp with means for adjusting its orientation relative to one of several stationary surfaces such as walls floors, ets., enabling achievement of multi-directional rocking motion via a single attachment point on the child care accessory.

In the preferred embodiment, the reciprocating arm is driven by a wheel to which one end is pivotably connected, rotation of th wheel being supplied by a DC motor.

In an alternative embodiment, the reciprocating arm is driven by a gear track mounted to one end thereof, the gear track meshing with the pinion gear of a reversibly rotating DC motor.

Another feature of the inventive device is the provision of an AC power unit comprising a pair of wall plugs extending from the housing in retractable fashion and a DC converter for recharging the batteries from an AC wall socket.

Still another feature of the inventive device is the provision of the reciprocating arm with a support pad at its extended end, the support pad having a friction-generating surface for insuring good contact with the stationary surface against which it is directed.

Yet another feature of the inventive device is the provision of the reciprocating arm with threaded extension sections for increasing the length thereof in particular applications.

Still another feature of the inventive device is the provision of a sound detector responsive to infant crying sounds for actuating the drive mechanism on an adjustable timer.

In those applications where the child care accessory is not suited to rocking motion based on its shape alone, a hemispherically-shaped dish is provided in which the accessory can be placed. Attachment of the inventive device to the dish imparts rocking motion directly thereto, and thereby indirectly to the child care accessory, by virtue of its placement therein.

Designed as a hand-held portable unit, the inventive device offers a readily available and easily attachable appliance for imparting multi-directional rocking motion in a variety of applications.

Other advantages of the invention will become apparent from the drawings and the description contained hereinbelow.

BRIEF DESCRIPTION OF THE DRAWINGS

For a better understanding of the present invention with regard to the preferred embodiments, reference is made to the accompanying drawings in which like numerals designate corresponding elements or sections throughout, and in which.

DETAILED DESCRIPTION OF THE PREFERRED EMBODIMENTS

Figure 1:
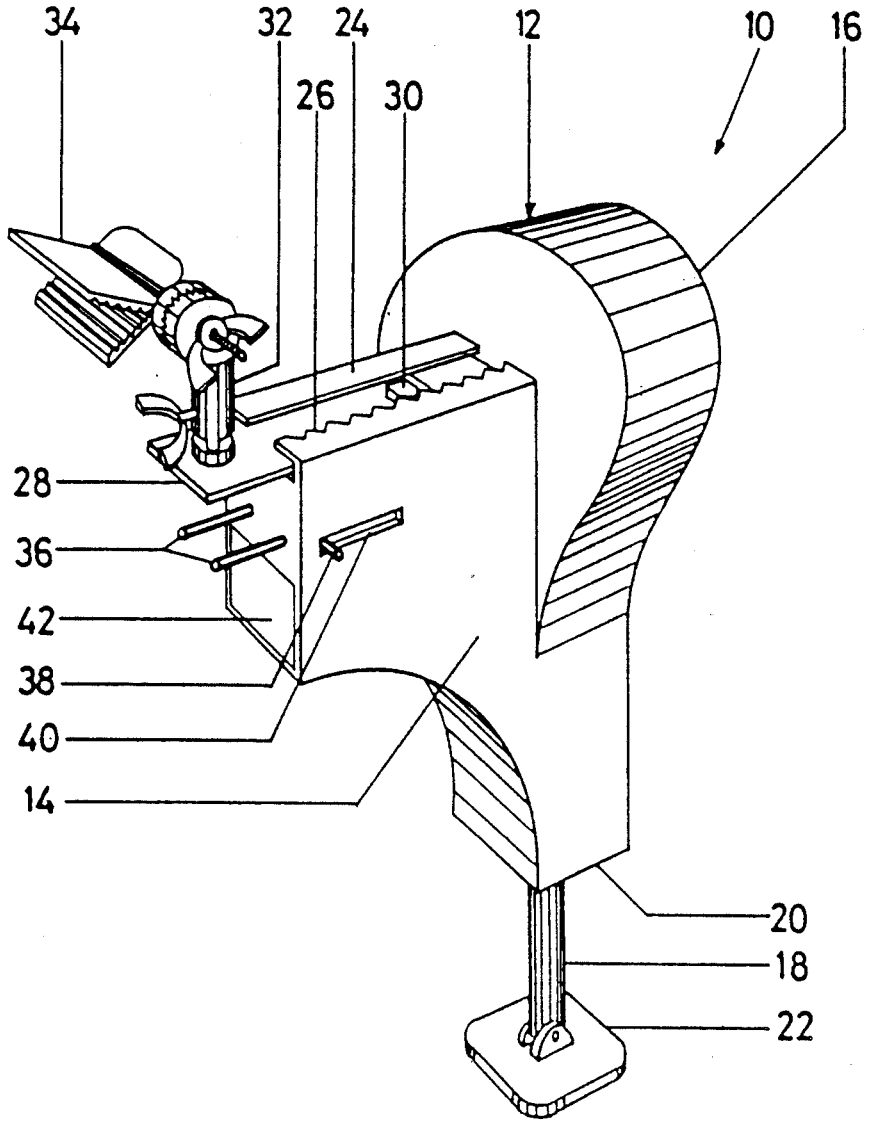
FIG. 1 shows an overall perpective view of a preferred embodiment of a device for imparting multi-directional rocking motion in accordance with the principles of the present invention.

Referring now to FIG. 1, there is shown a preferred embodiment of a device 10 for imparting multi-directional rocking motion which is constructed and operative in accordance with the principles of the present invention. The inventive device 10 comprises a housing 12 having internally joined hollow compartments 14 and 16. Housing 12 may be constructed as a molded under fabricated from a lighweight plastic. Compartment 14 encloses a power unit and motor drive, while compartment 16 encloses a drive mechanism for powering the stroke of a reciprocating arm 18 extending external thereto through a bottom end wall 20. The external end of reciprocating arm 18 is pivotably attached to a support pad 22.

An upper surface of compartment 14 is shaped to provide smooth and serrated flanges 24 and 26 which enclose a space for insertion of a slidably extendable panel 28. A button 30 on panel 28 engages serrated flange 26 to provide position locking once panel 28 has been extended by a desired amount. Adjustably mounted on a post 32 supported by panel 28 is a spring-loaded attachment clamp 34. Panel 28 and post 32 provide orientation adjustment for clamp 34 as further described herein.

A pair of wall plugs 36 for use with an AC power outlet is shown extending through a side wall in compartment 14. Plugs 36 are arranged to be retractable within compartment 14 by movement of a lever 38 slidably mounted in a slot 40 formed in a side wall of compartment 14. A removable door 42 in a compartment 14 side wall provides access to a set of batteries (not shown) which are retained therein in a battery holder and are used to power inventive device 10.

Figure 2A:
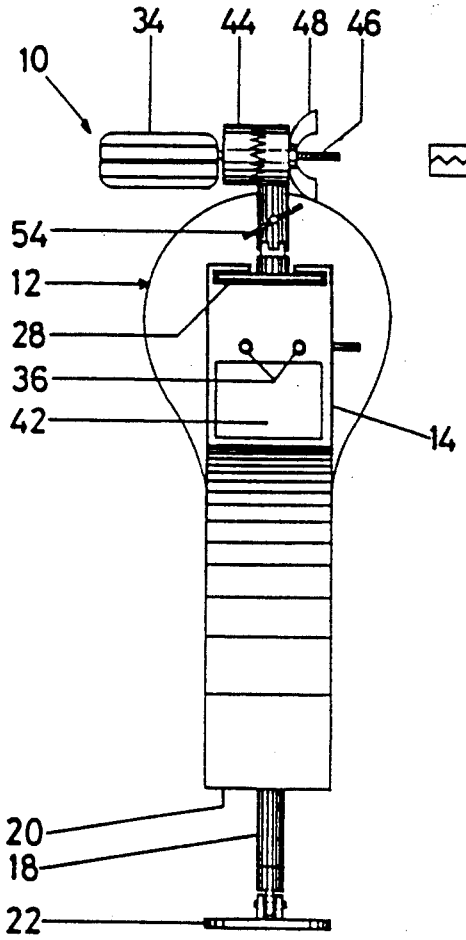
FIGS. 2*a–c* show respective end elevation, side and top views of the inventive device of FIG. 1.
Figure 2B:
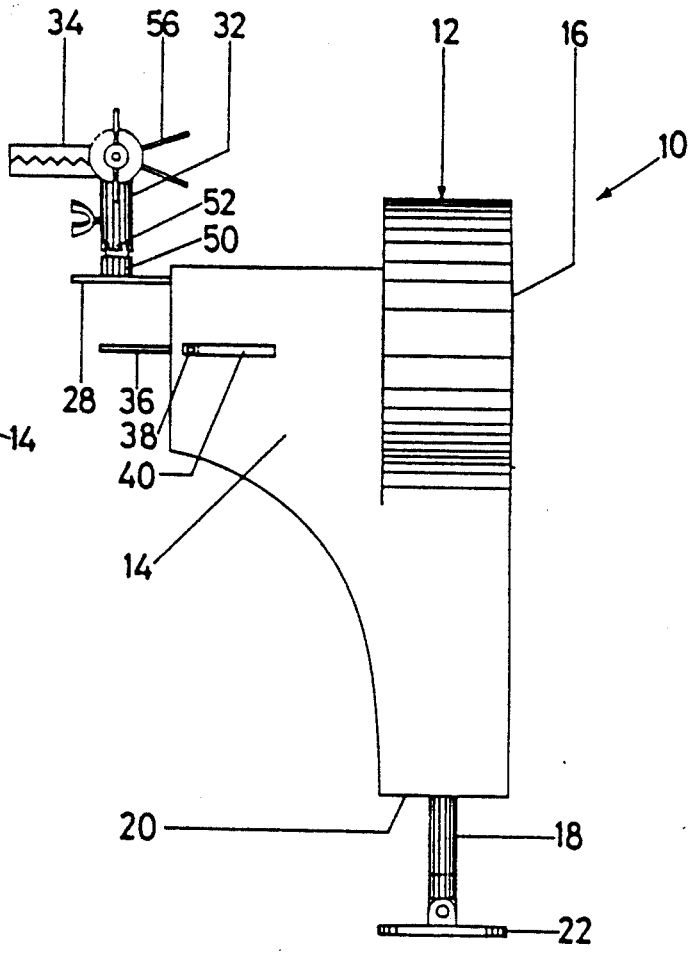
Figure 2C:
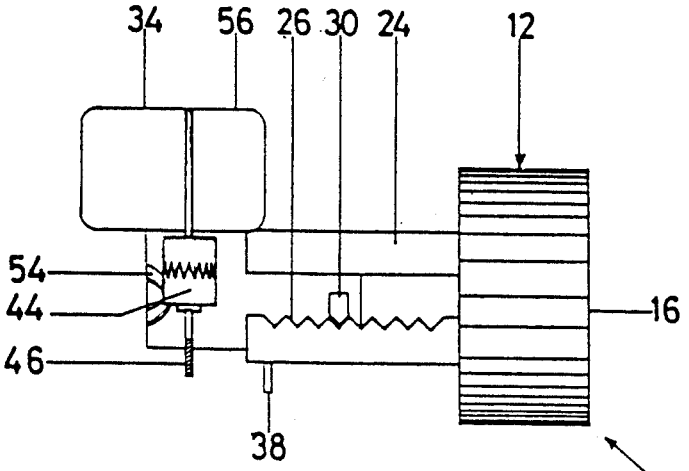

Turning now to FIGS. 2*a–c*, there are shown respective end elevation, side and top views of inventive device 10 of FIG. 1. Visible in FIG. 2*a* is an adjustably oriented connector 44 formed by two halves of a cylindrical block having serrated faces, the right half being rigidly fastened to post 32 and the left half being rigidly fastened to a pin 46 extending from attachment clamp 34. A wing nut 48 engages the threaded end of the pin 46 for tightening thereof, thereby determining the elevation orientation of attachment clamp 34.

Attachment clamp 34 is arranged for swivel motion by rotation of post 32 about a cylindrical support 50 which is rigidly affixed to panel 28. Post 32 is hollow and is seated over support 50 which has an annular groove therein. A set of tabs 52 integrally formed in an end of post 32 are loosely retained in the annular groove, thus allowing rotation of post 32 with respect to panel 28. Wing nut 54 is threaded through a hole in post 32 and serves to tighten it to support 50, thus determining the aximuthal orientation of attachment clamp 34. A pair of finger clips 56 forming a portion of attachment clamp 34 enable it to be opened against a spring-loaded clamping force.

Figure 3A:
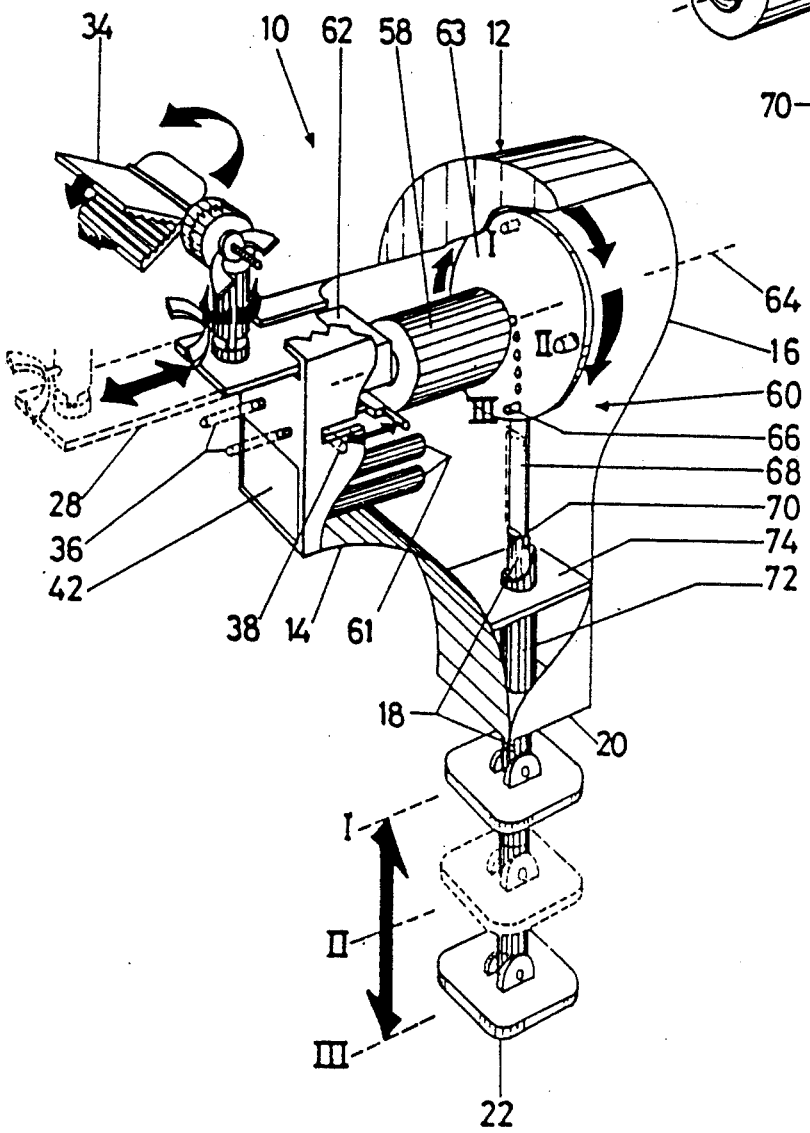
FIG. 3*a* shows a prespective view of a partial cutaway illustration of the inventive device of FIG. 1, revealing the drive mechanism for a reciprocating arm thereof.
Figure 3B:
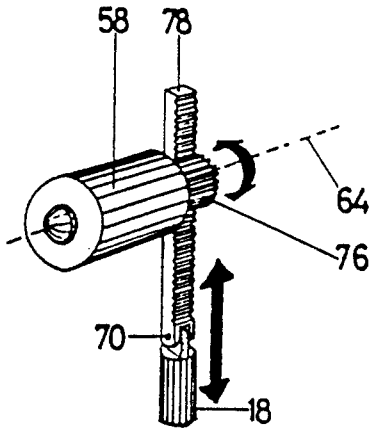
FIG. 3*b* shows an alternative embodiment of the drive mechanism of FIG. 3*a;*
Figure 3C:
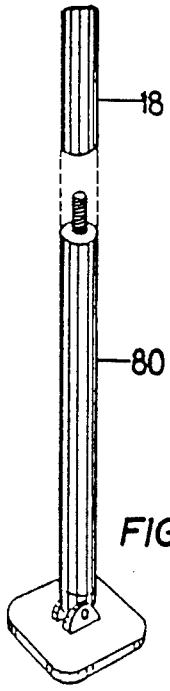
FIG. 3*c* shows an enlarged view of a threaded extension section of the reciprocating arm of FIG. 3*a;*

Referring now to FIGS. 3*a–c*, there is shown a partial cutaway view of housing 12 which reveals a DC motor 58 and drive mechanism 60 for providing reciprocating motion of arm 18. Motor 58 is suitably mounted in compartment 14 together with a power unit which comprises a set of batteries 61 rechargeable by an AC transformer-DC converter 62 combination connected to wall plugs 36. Motor 58 and the power unit are provided by a suitable arrangement of standard components to achieve maximum torque with low voltages, such as by use of a 6 volt battery supply and powerful permanent magnet DC motor capable of lifting loads up to approximately 33 kilograms.

In the preferred embodiment, drive mechanism 60 comprises a wheel 63 centrally mounted on the rotation axis 64 provided by the shaft of motor 58. Wheel 63 has a series of holes along a radius thereof, with a retaining pin 66 being inserted in one of the holes for pivotably attaching a rigid member 68 thereto. The other end of rigid member 68 is pivotably attached by pin 70 to reciprocating arm 18, which passes through a hollow cylindrical sleeve 72 extending within the lower portion of compartment 16 between a support plate 74 and bottom end wall 20.

In operation, when the power unit is operated by an on-off switch suitably mounted on housing 12, motor 58 provides rotation of wheel 63 in the direction shown. In turn, drive mechanism 60 provides reciprocating motion of arm 18 and support pad 22 external to housing 12 in positions I, II and III as illustrated. The stroke of the reciprocating motion can be varied by adjustment of retaining pin 66 in different holes on wheel 63. The speed of the reciprocating motion can be adjusted by a suitably mounted switch for adjusting the battery output voltage.

A feature of inventive device 10 is the provision of a sound detector (not shown) responsive to infant crying sounds for actuating the motor 58 and drive mechanism 60 for a duration determined by an adjustable timer.

In FIG. 3*b*, an alternative embodiment is shown for drive mechanism 60, comprising motor 58, a pinion gear 76 mounted on the rotation axis 64 provided by the shaft of motor 58, and a gear track 78. In this arrangement, motor 58 provides a reversible rotation motion to drive gear track 78 and arm 18 with reciprocating motion. The direction of motor 58 rotation and the resulting stroke of gear track 78 is controlled by a microswitch (not shown) mounted within the body of motor 58 or in proximity to gear track 78 for detecting the limits of its travel.

FIG. 3*c*, there is shown a rigid extension section 80 adapted for threadable attachmemt to arm 18. This enables extension of reciprocating motion, which is useful in many applications.

Figure 4A:
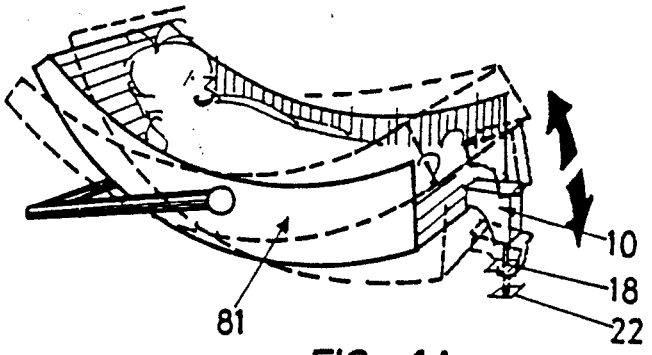
FIGS. 4*a–c* show various attachment schemes for directly imparting rocking motion to various child care accessories, respectively, an infant seat, a cradle and a riding horse.
Figure 4B:
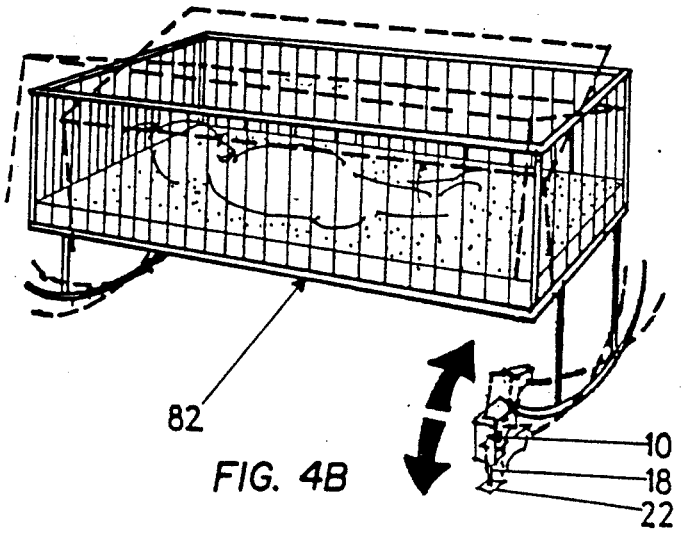
Figure 4C:
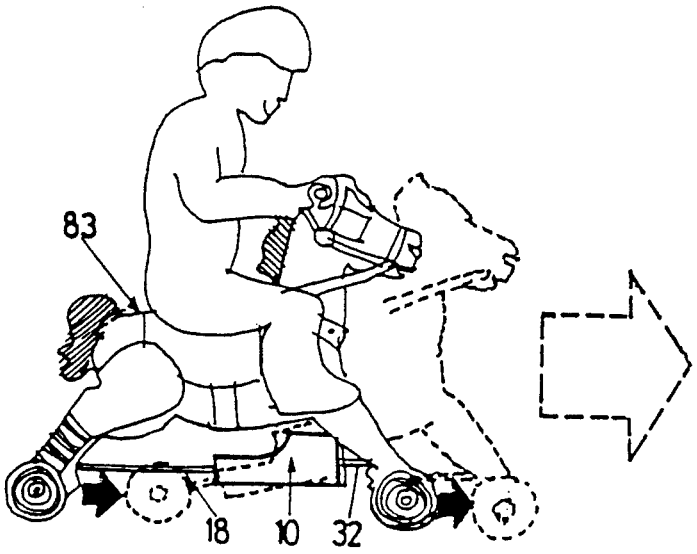

In FIGS. 4*a–c*, there are shown sample applications of the inventive device 10 with several child care accessories, respectively, an infant seat 81, a cradle 82 and the riding horse 83. In each of these sample applications, the accessory is already designed for rocking or jumping motion. Using the adjustment features provided by panel 28, post 32, adjustably oriented connector 44, and wing nuts 48 and 54, inventive device 10 can be directly attached via attachment clamp 34 to an appropriate location on the body of the accessory.

In accordance with the principles of the present invention, the orientation of attachment clamp 34 is adjusted such that reciprocating arm 18 is directed against a stationary surface, such as the floor, in the case of infant seat 81 and cradle 82. Support pad 22 may have a frictional surface such as rubber to ensure good contact with the stationary surface.

When drive mechanism 60 is operated as previously described, reciprocating motion of arm 18 acts impart rocking motion to the child care accessory. By virtue of its direct attachment to the accessory, inventive device 10 convertes the attachment point to a "base" fo the drive mechanism, eliminating the stationary support base of prior art systems.

In the case of the riding horse, a particular toy design is available in the market having a known design feature, namely, that it can be operated to jump forward by forward lateral movement of its front legs. The inventive device 10 is arranged to take advantage of this feature by providing the forward lateral movement of the front legs, such that the horse jumps forward by virtude of its design.

Figure 5A:
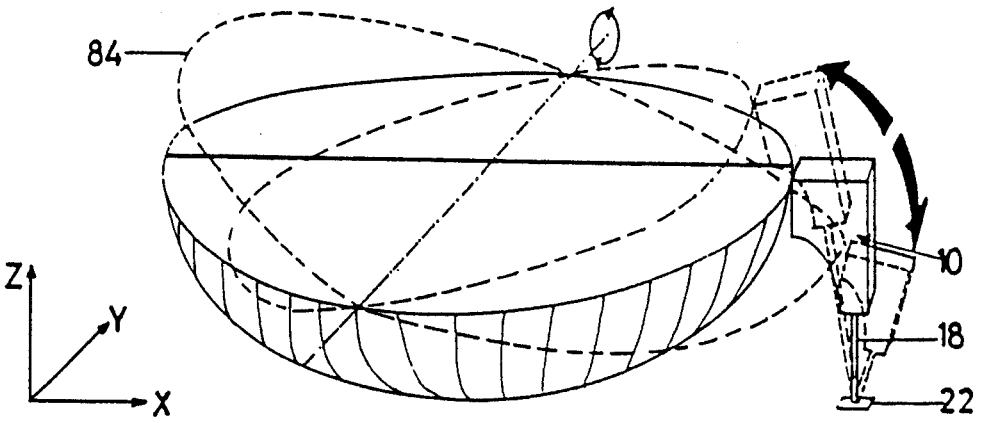
FIGS. 5*a–c* show respective schemes for attaching the inventive device to a hemispherically-shaped dish for indirectly imparting rocking motion to accessories placed therein.
Figure 5B:
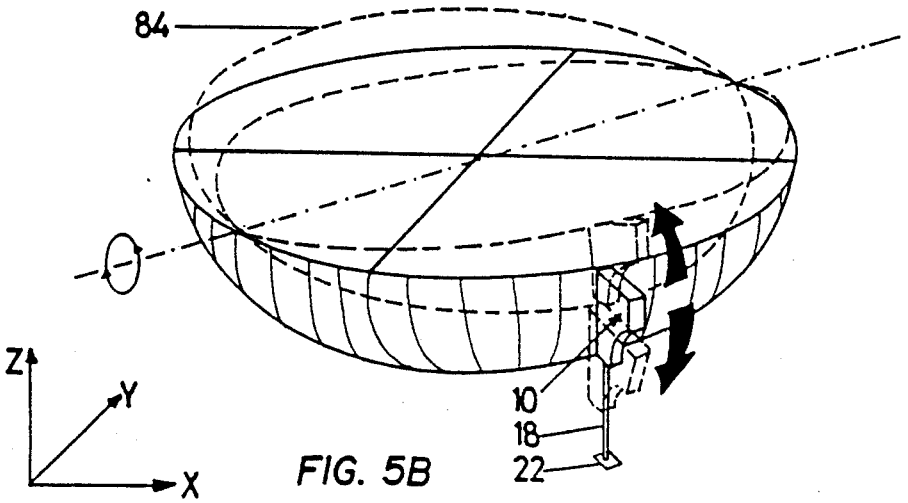
Figure 5C:
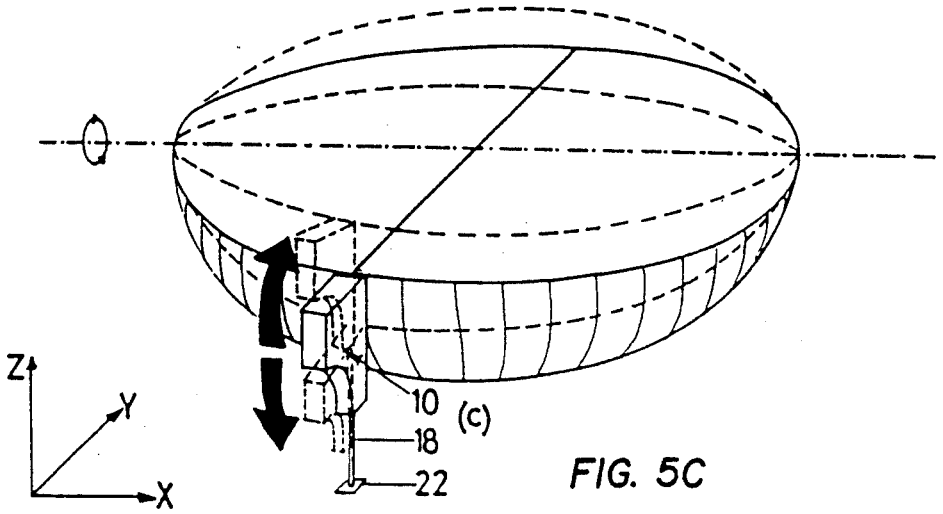

Referring now to FIGS. 5*a–c*, there are shown respective attachment schemes for using inventive device 10 with a hemispherically-shaped dish 84 for impating multi-directional rocking motion. This approach is useful especially where the shape of the child care accessory is not suited to enable rocking motion. By attachment of inventive device 10 to dish 84 and placement of the accessory therein, the rocking motion which is imparted directly to dish 84 is indirectly imparted to the child care accessory, by virtue of its placement therein.

As illustrated in each of FIGS. 5*a–c*, a set of reference coordinate axes x, y and z defines a multi-directional set of possible rocking motions. Selected examples in this set include that shown in FIG. 5*a*, whereby attachment of device 10 to a side of dish 84 imparts rocking motion along the y axis. FIG. 5*b* shows an arrangement whereby device 10 is attached so as to impart rocking motion along an axis intermediate the x and y axes, while in FIG. 5*c*, attachment of device is such as to impart rocking motion along the x axis.

In light of the foregoing, it will be appreciated that the design of inventive device 10 provides a compact, portable, self-contained, safe and reliable mechanism for imparting multi-directional rocking motion in a variety of child care toys and accessories. The overall length and weight of the preferred embodiment of device 10 are respectively 7–10 cm and 200 grams, both approximate figures. Elimination of the stationary support base characterizing prior art systems makes the inventive design a simple and readily available solution to the problems of mechanized rocking systems.

Having described the invention in connection with certain specific embodiments thereof, it is to be understood that the description is not meant as a limitation since further modifications may now suggest themselves to those skilled in the art and it is intended to cover such modifications as fall within the scope of the appended claims.

I claim:

1. A device for imparting multi-directional rocking motion comprising:

a housing;

a drive means supported by said housing for providing reciprocating motion to an arm extending through a wall thereof;

means for attaching said housing to a component arranged for rocking motion in relation to a surface;

said housing being attached so as to direct said arm for contact with said surface during its reciprocating motion, said rocking motion being imparted to said component in accordance with said arm direction; and a support pad atached at the extended end of said reciprocating arm, said support pad having a friction-generating surface for ensuring good contact with said stationary surface against which it is directed.

2. A device for imparting multi-directional rocking motion comprising:

a housing;

a drive means supported by said housing for providing reciprocating motion to an arm extending through a wall thereof;

means for attaching said housing to a component arranged for rocking motion in relation to a surface;

said housing being attached so as to direct said arm for contact with said surface during its reciprocating motion, said rocking motion being imparted to said component in accordance with said arm direction; and a hemispherically-shaped dish for holding of said component, attachment of said device to said dish imparting rocking motion directly thereto, and thereby indirectly to said component, by virtue of its placement therein.

3. A method of imparting multi-directional rocking motion to a component, said method comprising the steps of:

providing reciprocating motion to an arm extending from a mechanism attached to the component and;

directing said arm in relation to a surface;

said directed arm contacting said surface during its reciprocating motion to impart rocking motion to said component in accordance with said arm direction;

wherein said mechanism is attached to a hemispherically-shaped dish for holding of said component, attachment of said mechanism to said dish imparting rocking motion directly thereto, and thereby indirectly to said component, by virtue of its placement therein.

* * * * *